United States Patent [19]

Etemovich

[11] Patent Number: 4,631,093

[45] Date of Patent: Dec. 23, 1986

[54] CHROMATE FREE METHOD OF TREATING METAL SUBSTRATES TO IMPART CORROSION RESISTANCE AND COLOR TO THE SUBSTRATE SURFACE

[75] Inventor: Alex Etemovich, Fountain Valley, Calif.

[73] Assignee: TRE Corporation, Beverly Hills, Calif.

[21] Appl. No.: 635,056

[22] Filed: Jul. 27, 1984

[51] Int. Cl.[4] ..... C23C 22/48

[52] U.S. Cl. ..... 148/6.1; 8/522

[58] Field of Search ..... 148/6.1, 6.24, 6.27, 148/31.5; 8/522

[56] References Cited

U.S. PATENT DOCUMENTS

| | | | |
|---|---|---|---|
| 2,238,771 | 4/1941 | Cheslar | 8/152 |
| 2,393,640 | 1/1946 | King | 8/522 |
| 3,079,309 | 2/1963 | Wainer | 8/522 |
| 4,391,894 | 7/1985 | Shimazu | 430/197 |

FOREIGN PATENT DOCUMENTS

| | | | |
|---|---|---|---|
| 689604 | 6/1964 | Canada | 148/6.1 |

OTHER PUBLICATIONS

Needles, Handbook of Textile Fibers, Dyes and Finishes, 5/10/82.

*Primary Examiner*—Sam Silverberg

*Attorney, Agent, or Firm*—Spensley, Horn, Jubas & Lubitz

[57] ABSTRACT

Chromate-free aqueous solutions for treating metal surfaces to impart corrosion resistance and decorative colors are disclosed. The treated metal surface equals or exceeds ASTM adhesion standards for chromate treated metal surfaces. The solutions can be used to give the metal surface a wide range of colors.

19 Claims, No Drawings

CHROMATE FREE METHOD OF TREATING METAL SUBSTRATES TO IMPART CORROSION RESISTANCE AND COLOR TO THE SUBSTRATE SURFACE

BACKGROUND OF THE INVENTION

1. Field of the Invention

The present invention relates to a chromate free chemical solution for treating metal surfaces. More particularly, the present invention relates to an aqueous dipping solution for adding corrosion resistance to a metal surface and for providing the metal surface with a decorative color.

2. Prior Art

There are a variety of methods for treating metal surfaces for an equally wide variety of desired purposes. For example, many metal surfaces are treated to provide corrosion protection, abrasion resistance or to impart a desired decorative or identification color. Such methods include chromate conversion coating, immersion or electrolytic plating, metal coloring and electroless (autocatalytic) plating, etc. Although these methods do work for their intended purposes, there are certain problems associated with each method.

For example, in the chromate conversion coating method, the presence of hexavalent and trivalent chromium creates toxicity and pollution hazards. The problem with the chromate is that its use in treating metal surfaces results in a hazardous waste product. At present, using chromate requires a costly and time consuming effluent treatment process. Eventually it may be impossible to treat such waste products without investing in a complete reclamation system which is expected to be very expensive. As a result, there is presently a great need for a metal treating solution which will give the metal substrate corrosion resistance as well as the surface color provided by chromate treatment, without the pollution problems attendant with the use of chromate solutions.

Another disadvantage associated with the chromate conversion coating method is that chromate conversion coating is in general limited to treating aluminum, cadmium, copper, magnesium, silver and zinc, and is limited in the variety and depth of colors obtainable. These two problems are also associated with immersion plating. Further, the hazardous waste problem of the chromate conversion coating method is also present in processes for coloring metals with mordant dyes since such processes often require the formation of a chromate film on the surface of the metal substrate prior to coloring.

The closest method associated with the process of the present invention is known as staining or coloring of metals. Such processes are disclosed in German Pat. No. 149,566, German Pat. No. 163,067; Beutel, *Bewahrte Arbeitsweisen der Metalfarbung,* Second Edition, 1925; Groschuff, *Phys. Techn. Reichs Inst. Deutche Mechaniker Zeitung,* 1913, Vol. 22, pages 233–239, and U.S. Pat. No. 2,295,842. However, the staining or coloring method requires high heat, and typically, other post-treatment processes to remove oxides or other undesired precipitates from the metal substrate.

Therefore, it is an object of the present invention to provide a solution for treating metal surfaces which will impart the metal substrate with increased corrosion resistance and the metal substrate surface with a wide variety of decorative colors without producing hexavalent or trivalent chromium waste products. It is a further object of the present invention to provide a simple and inexpensive process for treating metal substrates to increase corrosion resistance and to impart a wide range of decorative colors with the process being performed at ambient temperature, primarily—and, or if desirable, temperature can be increased.

SUMMARY OF THE INVENTION

The present invention provides a process and a variety of treating solutions for coating a metal substrate surface with a film which imparts improved corrosion resistance to the metal substrate and which also imparts a desirable color to the metal substrate surface. The process can be used for all metals including, but not limited to, zinc, zinc alloy, zinc plate, cadmium, cadmium alloy, aluminum, magnesium and steel. The process is very simple and economic to control and operate, and is performed at ambient temperature.

The solutions of the present invention include either a basic dye or at least one transition metal salt, single or double, in an aqueous solution. The solutions can be made acidic by using almost any acid or be made basic by using almost any base. If a transition metal salt is used, the solutions can be either basic or acidic in the pH range of from 0 to 14. If a basic dye is used, the solutions should be acidic.

Other ingredients can be added to the solution such as organic and inorganic dyes, UV absorbers, film formers, stabilizers, surfactants and other organic and inorganic additives to obtain other desirable physical and chemical properties. Additional metal salts may be added to the solution to achieve other desirable physical and chemical properties, such as color or appearance modification, increased corrosion resistance, or increased film thickness.

DETAILED DESCRIPTION OF THE INVENTION

The present invention is applicable to impart improved corrosion resistance and a decorative appearance to metal surfaces. Each of the solutions of the present invention described in detail below, when used in accordance with the process of the present invention, treats the metal substrate so that the coating of the resulting treated metal substrate meets or exceeds the ASTM (American Society for Testing and Materials) standard for adhesion of the coating on a treated metal substrate.

The process of the present invention generally involves three steps. The first step is cleaning the metal substrate. In general, cleaning the metal substrate includes (a) passing the metal substrate through an alkaline or acid cleaner to remove any oils or grease, (b) rinsing the metal substrate with distilled water, (c) passing the rinsed metal substrate through an acid solution to clean off any oxide film, and then (d) rinsing the metal substrate.

The second step is immersing the cleaned metal substrate into a treatment solution of the present invention for a desired length of time. Of course, the length of time and concentration of ingredients is proportional to the depth of color and thickness of coating desired.

The third step is a post treatment step and involves rinsing the dipped substrate, drying and, where desired, lacquering the dried surface to add additional corrosion protection and abrasion resistance.

In order to further illustrate the present invention, the following examples of treatment solutions are provided. It will be understood that the examples are provided for illustrative purposes only and are not intended to limit the scope of the invention as herein disclosed and as set forth in the subjoined claims.

Except as otherwise noted the following examples yielded a yellow brass appearance on the surface of zinc or cadmium metal substrates and a copper or bronze appearance on the surface of steel substrates depending upon the immersion time. The preparation of the solutions and the treatment of the metal substrate was done at room temperature, with the substrate being immersed in the solution for approximately five seconds.

EXAMPLE 1

| Ingredient | Range per Liter Water |
|---|---|
| nitric acid | 1 ml to 25 ml |
| copper sulfate | 0.5 g to saturation |
| aluminum potassium sulfate | 0.5 g to saturation |
| potassium permanganate | 0.25 g to saturation |

By changing the concentration of any of the ingredients in the examples set forth herein, and by adding other additives such as those listed below, one can obtain improved adhesion, abrasion resistance, corrosion protection and other colors. For example, adding gelatin to the solution improved the adhesion of the coating. Adding nickel sulfate to the solution yielded darker tones of colors and increased corrosion protection. Adding other metal salts or substituting the above metal salts with organic and inorganic dyes, UV absorbers or other absorbers can yield a variety of colors. Film formers, surfactants or wetting agents can also be added.

EXAMPLE 2

| Ingredient | Preferred Amount per Liter Water |
|---|---|
| nitric acid | 5 ml |
| copper sulfate | 5 g |
| aluminum potassium sulfate | 5 g |
| potassium permanganate | 3.5 g |
| gelatin | 1 to 5 g |

EXAMPLE 3

| Ingredient | Preferred Amount per Liter Water |
|---|---|
| aluminum chloride | 5 g |
| nickel sulfate | 5 g |
| acetic acid | 5 ml |
| uranyl acetate | 3.5 ml |
| gelatin | 1 to 5 g |

EXAMPLE 4

| Ingredient | Preferred Amount per Liter Water |
|---|---|
| nitric acid | 10 ml |
| copper sulfate | 20 g |
| potassium permanganate | 10 g |
| potassium oxalate | 10 g |
| nickel sulfate | 13.5 g |

-continued

| Ingredient | Preferred Amount per Liter Water |
|---|---|
| gelatin | 1 to 5 g |

It is noted that the potassium oxalate of Example 4 is equivalent to the aluminum potassium sulfate used in Examples 1 and 2. Further, oscalic acid can be substituted for potassium oxalate. Also, increasing the nickel sulfate or nitric acid concentration will produce a darker finish. It is also noted that the solution set forth in Example 4 yielded a satisfactory colored finish on steel substrates.

EXAMPLE 5

| Ingredient | Preferred Amount per Liter Water |
|---|---|
| aluminum chloride | 15 g |
| copper sulfate | 25 g |
| nickel sulfate | 25 g |
| manganous sulfate | 5 g |
| lactic acid | 25 ml |
| acetic acid | 25 ml |

In Example 5, the above ingredients were added to 1 liter of water, 5 more milliliters of acetic acid were added and then 1.7 grams of potassium permanganate were added. The resulting solution yielded an adherent, yellow brass coloring on zinc which passed the ASTM standards for adhesion comparable to the chromate conversion coating method.

EXAMPLE 6

| Ingredient | Preferred Amount per Liter Water |
|---|---|
| nitric acid | 5 ml |
| copper sulfate | 15 g |
| nickel sulfate | 10 g |
| potassium permanganate | 15 g |
| aluminum potassium sulfate | 15 g |

EXAMPLE 7

| Ingredient | Preferred Amount per Liter Water |
|---|---|
| zinc chloride | 25 g |
| nickel sulfate | 25 g |
| copper sulfate | 25 g |
| nitric acid | 5 ml |
| potassium permanganate | 5 g |
| potassium chloride | 25 g |

It should be noted that in Example 7, the zinc chloride and the potassium chloride are equivalent to the aluminum potassium sulfate used in several of the previous examples. Instead of using zinc chloride and potassium chloride, cobalt or nickel chloride together with sodium chloride can be used.

EXAMPLE 8

| Ingredient | Preferred Amount per Liter Water |
|---|---|
| potassium oxalate | 12.5 g |
| copper sulfate | 7.5 g |
| nickel sulfate | 5.0 g |

-continued

| Ingredient | Preferred Amount per Liter Water |
|---|---|
| nitric acid | 5 ml |
| potassium permanganate | 5 g |

EXAMPLE 9

| Ingredient | Preferred Amount per Liter Water |
|---|---|
| oxalic acid | 26.5 ml |
| aluminum chloride | 10 g |
| copper sulfate | 10 g |
| acetic acid | 10 ml |
| nitric acid | 5 ml |

It is noted that in all of the above examples copper sulfate can be replaced in whole or in part with copper chloride.

EXAMPLE 10

| Ingredient | Range or Amount per Liter Water |
|---|---|
| a salt of sodium | 2.5 to 75 g |
| acetic acid | 0.15 to 25 ml |
| lead acetate | 1.0 to 35 g |
| sodium thiosulfate | 1.0 to 75.5 g |
| formaldehyde | 0.25 to 25.5 ml |

The ingredients in Example 10 can be combined in whole or in part with the ingredients in Example 9 to achieve other desired properties, such as improved film thickness, adhesion, abrasion or corrosion resistance. Formaldehyde improves the solution stability and coating appearance. Using lead acetate and sodium thiosulfate yields treated metal substrates having darker color tones of the colors noted previously. It should be appreciated with respect to the ingredients in this example that almost any color surface is obtainable depending upon the commercial colored salt of sodium chloride available and applied. Also, it may be desirable to increase the temperature above 25° C.

The present invention also contemplates treating metals electrolytically as follows in Example 11. A metal substrate was dipped in the following solution which was electrolytically charged with 0.25 A/Current. The solution was filtered after mixing and also prior to dipping.

EXAMPLE 11

| Ingredient | Range per Liter Water |
|---|---|
| potassium chloride | 12.5 to 25 g |
| aluminum chloride | 5.0 to 21.5 g |
| copper sulfate | 2.5 to 10 g |
| boric acid | 4 to 8 ml |
| sulfuric acid | 2.5 to 5 ml |
| ammonium chloride | 12.5 to 25 g |
| 0.1 N silver nitrate | 2.5 to 5.0 ml |
| potassium permanganate | 2 to 4 g |
| potassium oxalate | 3 to 7.5 g |

The present invention also is not limited to metallic ingredients. For example, any basic dye of any color can be used in combination with a sufficient amount of acid, a lacquer and optionally a UV absorber. For example, a zinc substrate immersed in the following solution will have the appearance of yellow brass and will pass the ASTM adhesion standards for chromate if the dried, or wet dyed substrate is lacquered according to methods well known in the art. However, since basic dyes are not typically light fast, the color will fade if exposed to ultraviolet light. Therefore, an ultraviolet light absorber is added to the treatment solution to make the surface color of the treated metal substrate light fast. On the other hand, even without using such a UV absorber, the treated metal substrate is sufficiently corrosion resistant for use as an internal part or component of the product, not exposed to ultraviolet light.

EXAMPLE 12

| Ingredient | Range or Amount per Liter Water |
|---|---|
| basic orange #2 | 1.5 to 5.5 g/l |
| nitric acid | 1.5 to 15.0 ml/l |

The solutions of the present invention can be made acidic using almost any acid including but not limited to acetic, sulfuric, hydrochloric, phosphoric, nitric, hydrofloric or perchloric. The solution can be made basic using the sodium or potassium salts, tartarates, or ethylenediamine-tetra acetic acids, or ammonia. The substrate can be immersed from about one second to about one minute, depending upon the desired depth and darkness of color.

While it will be apparent that the preferred embodiments of the invention disclosed are well calculated to fulfill the objects stated above, it will be appreciated that the invention is susceptible to modification, variation and change without departing from the proper scope or fair reading of the appended claims.

What is claimed is:

1. An aqueous solution for imparting corrosion resistance and color to a metal surface comprising a chrysoidine dye and nitric acid, the pH of the solution ranging from 1.5 to 3.5.

2. An aqueous solution according to claim 1 further including a salt of sodium chloride and wherein the chrysoidine dye is basic orange #2.

3. An aqueous solution according to either of claims 1–2 wherein the metal is selected from the group consisting of zinc, cadmium or steel.

4. An aqueous solution according to claim 3 wherein the metal selected is zinc and the imparted color is yellow brass.

5. An aqueous solution according to claim 1 further including a water soluble compound which will prevent the color imparted by the chrysoidine dye from fading when a metal surface having been dipped in the solution is exposed to light.

6. An aqueous solution according to claim 1 further including an ultra-violet light absorber.

7. An aqueous solution according to claim 1, wherein the chrysoidine dye is basic orange number 2, wherein there is present from 1.5 to 5.5. grams of chrysoidine dye per liter of solution and wherein there is present from 1.5 to 15 milliliters of nitric acid per liter of solution.

8. A method for imparting corrosion resistance and color to the external surface of a metallic article of manufacture, the method comprising the steps of:

(1) cleaning the metal surface;

(2) dipping the cleaned metal surface resulting from step (1) in an aqueous solution comprising any basic dye and nitric acid;

(3) coating the metal surface resulting from step (2) with lacquer; and (4) drying the metal surface resulting from step (3).

9. A method according to claim 8 wherein the metal surface is zinc plate.

10. A method according to claim 8 wherein the basic dye is basic orange number 2 and wherein the acid is nitric acid.

11. A method according to claim 10 wherein there is present from 1.5 to 5.5 grams of basic orange number 2 per liter of aqueous solution and wherein there is present from 1.5 to 15 milliliters of nitric acid per liter of aqueous solution.

12. The metallic article of manufacture resulting from treatment according to the method of claim 8 wherein the metal is selected from the group consisting of zinc, cadmium or steel.

13. The metallic article of manufacture resulting from treatment according to the method of claim 9.

14. The metallic article of manufacture resulting from treatment according to the method of claim 10 wherein the metal is selected from the group consisting of zinc, cadmium or steel.

15. The metallic article of manufacture resulting from treatment according to the method of claim 11 wherein the metal is selected from the group consisting of zinc, cadmium or steel.

16. A method for imparting color to a metal surface comprising the steps of immersing the metal surface in a bath comprising any basic dye and nitric acid, removing the metal surface after immersion, and allowing the resulting metal surface to dry.

17. A method according to claim 16 wherein the basic dye is a chrysoidine dye.

18. A method according to claim 17 wherein the metal surface is zinc dye cast.

19. An aqueous solution consisting essentially of a chrysoidine dye and nitric acid, the pH of the solution being within the range of 1.5 to 3.5.

* * * * *